US005655193A

United States Patent [19]

Fujishiro et al.

[11] Patent Number: 5,655,193

[45] Date of Patent: Aug. 5, 1997

[54] DEVELOPING DEVICE FOR IMAGE FORMING APPARATUS WITH TONER RECIRCULATION OPERATION

[75] Inventors: Takatsugu Fujishiro, Tokyo; Minoru Suzuki; Hiroyuki Matsushiro, both of Yokohama; Noriyuki Kimura, Kawasaki; Katsuhiro Aoki, Yokohama; Chiyako Kobayashi, Tokyo, all of Japan

[73] Assignee: Ricoh Company, Ltd., Tokyo, Japan

[21] Appl. No.: 529,444

[22] Filed: Sep. 18, 1995

[30] Foreign Application Priority Data

Sep. 20, 1994 [JP] Japan ..... 6-253027
Jan. 6, 1995 [JP] Japan ..... 7-016500

[51] Int. Cl.[6] ..... G03G 15/08

[52] U.S. Cl. ..... 399/256; 399/254

[58] Field of Search ..... 355/259, 251, 355/253, 245; 118/653; 399/279, 254–256, 258

[56] References Cited

U.S. PATENT DOCUMENTS 4,755,847 7/1988 Matsushiro et al. .
4,835,565 5/1989 Nagatsuna et al. .
4,963,937 10/1990 Diehl ..... 355/251
5,115,275 5/1992 Suzuki .
5,331,390 7/1994 Kimura et al. .
5,339,141 8/1994 Suzuki et al. .
5,374,981 12/1994 Fujishiro et al. ..... 355/259
5,424,814 6/1995 Suzuki et al. .
5,465,139 11/1995 Kimura et al. .

OTHER PUBLICATIONS

U.S. application No. 08/227,347, filed Apr. 14, 1994.
U.S. application No. 08/224,291, filed Apr. 7, 1994.
U.S. application No. 08/248,678, filed May 25, 1994.
U.S. application No. 08/529,444, filed Sep. 18, 1995.
U.S. application No. 08/361,950, filed Dec. 22, 1994.

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

A developing device capable of obviating the cohesion of toner and reducing the amount of dead toner is disclosed. The device has a developing unit accommodating a first and a second screw therein. The first and second screws extend from the toner hopper to the other longitudinal end of the developing unit in parallel to a developing roller and a supply roller. The first screw feeds toner from a toner hopper to a developing section. The second screw collects toner not contributed to development from the developing section and returns it to the first screw for recirculation. In this configuration, the collected toner and dead toner aggregating in the lower portion of the developing unit are forcibly moved to the developing section. The direction in which the screw portion of the second screw is inclined may be partly reversed to form a reverse transfer portion. Alternatively, a part of a casing adjoining the hopper may be implemented as a slant. The reverse transfer portion or the slant recirculates the toner more forcibly.

7 Claims, 4 Drawing Sheets

DEVELOPING DEVICE FOR IMAGE FORMING APPARATUS WITH TONER RECIRCULATION OPERATION

BACKGROUND OF THE INVENTION

1. Field of the Invention

The present invention relates to a copier, facsimile apparatus, printer or similar image forming apparatus and, more particularly, to a developing device of the type having a developer carrier facing an image carrier for carrying a latent image thereon, a supply member for supplying a developer to the developer carrier, a first conveying member for conveying the developer from a storing section to a developing section where the developer carrier and supply member are located, and a second conveying member for conveying the part of the developer not contributed to development in a direction opposite to the conveying direction of the first conveying member.

2. Discussion of the Background

A horizontal developing device is extensively used in the imaging art and has a developing roller, a toner hopper, and an agitator arranged in the substantially horizontal direction. The toner hopper stores toner while the agitator delivers the toner to the developing roller. However, the problem with the horizontal developing device is that the sectional area of the device is greater than that of the image carrier or photoconductive element. This obstructs the free layout of the developing device.

In light of the above, Japanese Patent Laid-Open Publication No. 5-313488, for example, discloses a developing device having a toner conveying member parallel to a developing roller and a supply member, and a toner storing section positioned at the side of the device. Toner is fed from the storing section to the supply member sideways. This kind of scheme enhances the free layout of the device and miniaturizes the entire device even when three or four developing devices are combined as in a color copier or a color printer.

Japanese Patent Laid-Open Publication No. 3-180876 proposes a developing device having a supply member constantly buried in toner in a predetermined amount over the entire axial dimension thereof, so that a uniform toner layer can be formed on the surface of a developing roller. The developing device includes a casing accommodating the supply member and developing roller. The supply member has a cylindrical contour and supplies the toner to the developing roller while in rotation. The developing roller deposits the toner on the surface of an image carrier. A toner container is fluidly communicated to the casing. Toner replenishing means replenishes toner from the toner container to the casing. A dam extends in parallel to the axis of the supply member and divides the casing into a first section for holding the toner replenished by the replenishing means, and a second section for holding the toner over flowing from the first section over the dam. The supply member is disposed in the first section. Recirculating means is provided for recirculating the toner overflowing from the first section from the second section to the first section.

However, in the conventional developing devices described above, only the toner existing in the operation range of the supply member, which conveys the toner from the toner holding section to the developing device, contributes to development. As a result, it is likely that the toner outside the operation range is not used in the developing step and is wasted as so-called dead toner. Moreover, when the toner is continuously returned from the developing section to the storing section, it is apt to sequentially accumulate in the lower portion of the storing section and obstruct the following toner. Finally, this part of the toner will cohere and will not contribute to development forever.

SUMMARY OF THE INVENTION

It is, therefore, an object of the present invention to provide a developing device for an image forming apparatus and which is capable of preventing collected toner from cohering in the lower portion of the device.

It is another object of the present invention to provide a developing device for an image forming apparatus and which is capable of reducing the amount of dead toner not contributing to development and thereby obviating the waste of toner.

A developing device of the present invention has a developer carrier facing an image carrier on which a latent image is to be electrostatically formed. A supply member supplies a developer to the developer carrier. A first conveying member is located above a position where the supply member supplies the developer to the developer carrier, and conveys the developer from a storing section storing the developer to a developing section where the developer carrier and supply member are positioned. A second conveying member is located below the supply member and conveys the developer not contributed to development in the developing section in a direction opposite to the direction of conveyance of the first conveying member. A recirculation mechanism forcibly recirculates the developer by transferring the developer from the second conveying member to the first conveying member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
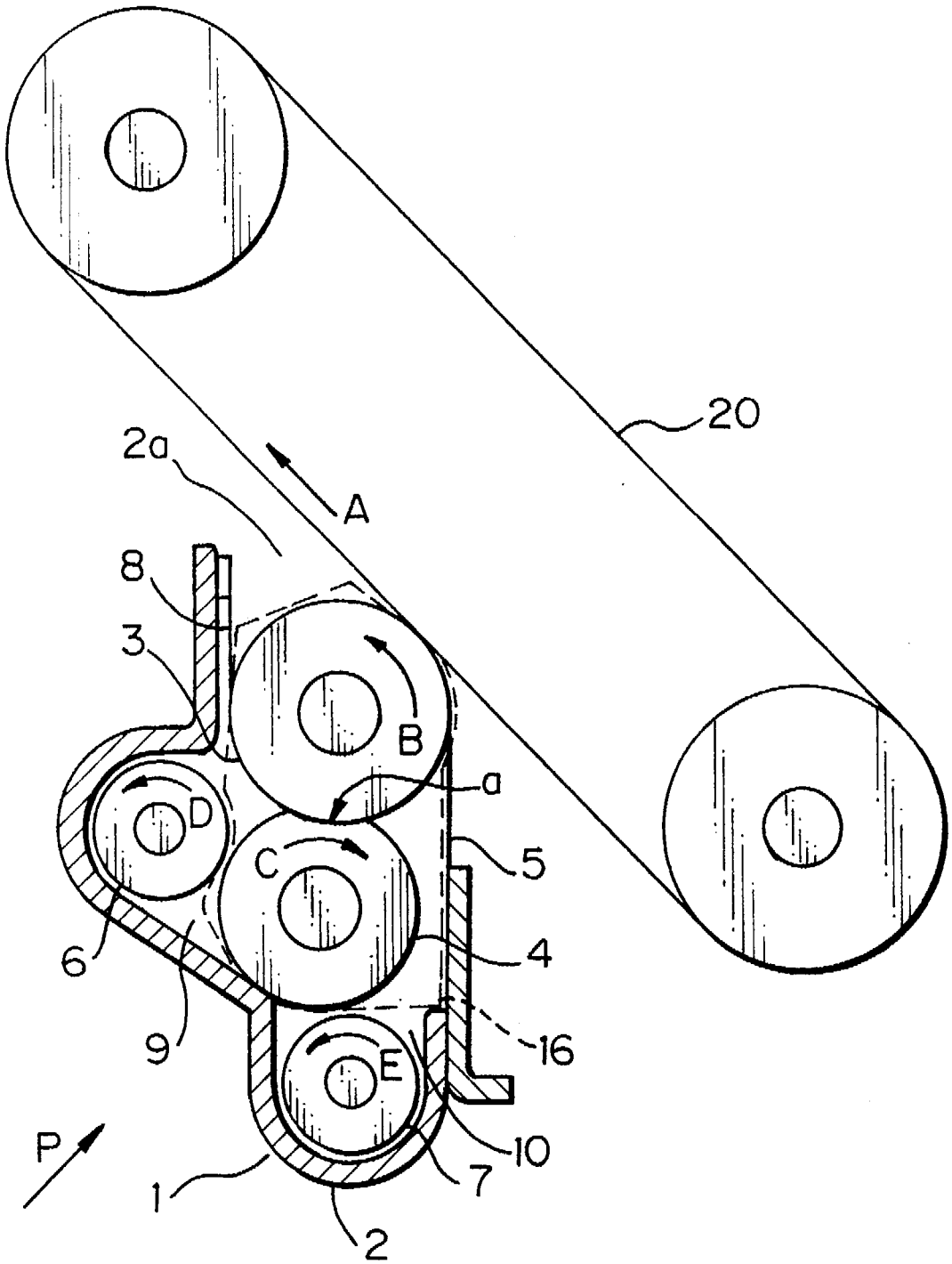
FIG. 1 is a vertical section of a developing device embodying the present invention.
Figure 2:
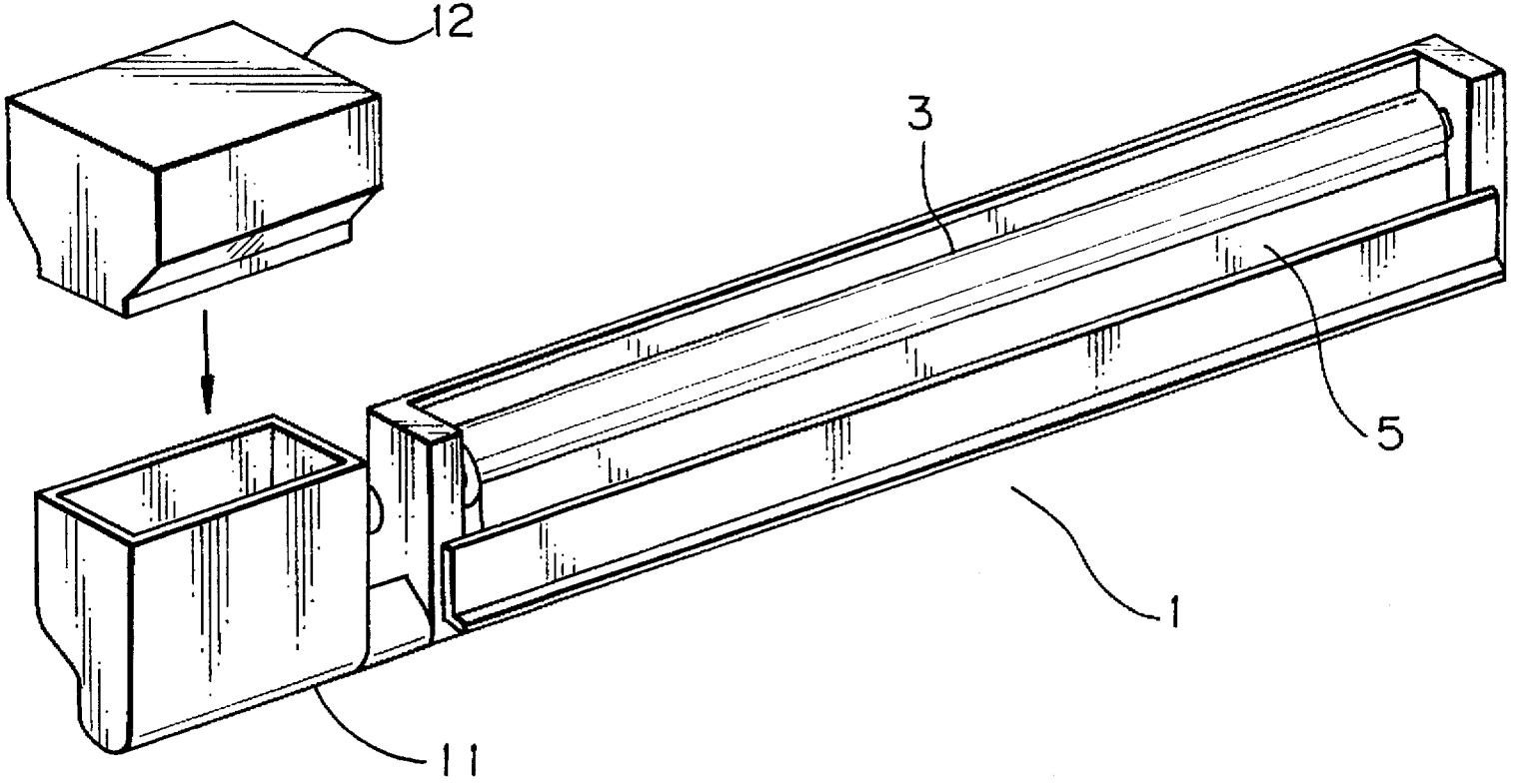
FIG. 2 is an external perspective view of the embodiment.

Referring to FIG. 1 of the drawings, a developing device embodying the present invention is shown and applied to an electrophotographic copier by way of example. Assume that the copier is operable with a nonmagnetic toner. FIG. 2 shows the developing device in an external perspective view. As shown in the figures, the developing device is disposed below an image carrier implemented as a photoconductive belt 20. The developing device is made up of a developing unit 1, a toner hopper 11 (see FIG. 2) storing the nonmagnetic toner or developer, and a toner cartridge 12 removably mounted to the top of the hopper 11. The toner hopper 11 is connected to one of longitudinally opposite ends of the developing unit 1 and is fluidly communicated to the inside of the unit 1. The developing unit 1 has a casing 2 formed with an opening 2*a* that faces the belt 20. A developing roller, or developer carrier, 3 is positioned in the casing 2 and faces the belt 20 through the opening 2*a*. The surface of the belt 20 is moved in a direction indicated by an arrow A. In the region where the developing roller 3 faces the belt 20, i.e., a developing region, the roller 3 is rotated in a direction B with a predetermined peripheral speed ratio to the belt 20. The directions A and B are the same as each other as viewed in the above developing region. A seal member 8 is held in contact at one end thereof with a part of the surface of the developing roller 3 downstream, in the direction B, of the position where the roller 3 faces the belt 20. The seal member 8 prevents the toner from leaking or flying about. A supply roller, or supply member, 4 is located below the developing roller 3 and is held in sliding contact with the roller 3. The supply roller 4 is formed of foam polyurethane or a similar elastic material. At a position a where the supply roller 4 contacts the developing roller 3, the roller 4 is moved in the same direction as the roller 3, as indicated by an arrow C in FIG. 1, with a predetermined peripheral speed ratio to the roller 3. At the position a, the toner is transferred from the roller 4 to the roller 3.

A blade 5 is held in contact at its free end with a part of the developing roller downstream of the position a in the direction B and in the vicinity of the opening 2*a*. The blade 5 is formed of urethane rubber or a similar elastic material and regulates the amount of toner to deposit on the developing roller 3.

Figure 3:
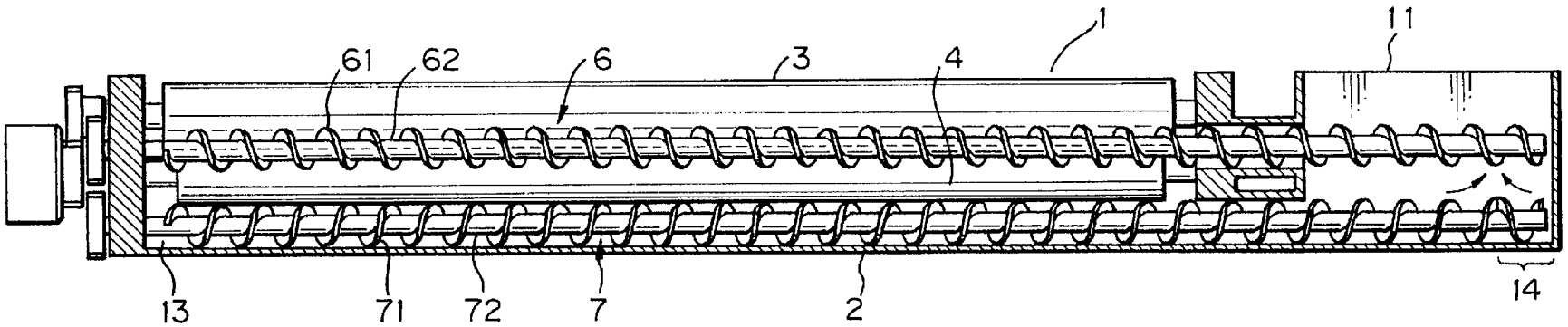
FIG. 3 is a sectional side elevation of the embodiment.

A screw, or first conveying member, 6 is located downstream of the opening 2*a*, but upstream of the position a in the direction B. Another screw, or second conveying member, 7 is positioned below the supply roller 4. As shown in FIG. 3, the screw 6 is made up of a shaft 61 and a screw portion, 62 while the screw 7 is made up of a shaft 71 and a screw portion 72. The screws 6 and 7 extend in parallel to the developing roller 3 and supply roller 4 from one end of the developing unit 11 where the toner hopper 11 is absent to the end of the hopper 11. The screws 6 and 7 are respectively rotated in directions D and E, FIG. 1, in interlocked relation to and in a predetermined peripheral speed ratio to each other.

The supply roller 4 contacts not only the developing roller 3 but also the casing 2. In this condition, the developing roller 3, supply roller 4 and casing 2 define a toner supply space 9 surrounding the screw 6, and a toner collection space 10 surrounding the screw 7. A toner drop section 13 (see FIGS. 3 and 4) is formed at the rear end of the developing unit 1, as seen in the direction perpendicular to the sheet surface of FIG. 1 (right end in FIG. 2), and communicated to the collection space 10. The toner conveyed through the space 9 drops into the toner drop section 13 and is then introduced into the collection space 10.

In operation, toner is replenished into the toner hopper 11 from the toner cartridge 12 removably mounted to the hopper 11. When the screw 6 is rotated in the direction D, it conveys the toner through the supply space 9 from the front to the rear, as seen in the direction perpendicular to the sheet surface of FIG. 1 (from the left to the right in FIG. 2). Hence, the toner is deposited on the supply roller 4 over the entire axial dimension of the roller 4. The supply roller 4, rotating in the direction B, supplies the toner to the developing roller 3 at the position a. At this instant, the toner is charged by friction acting between the rollers 3 and 4. The toner deposited on the developing roller 3 is regulated by the blade 5 to form a uniform thin layer having a predetermined thickness. The thin toner layer develops a latent image electrostatically formed on the belt 20, contacting or not contacting the belt 20.

FIG. 3 is a section of the developing device as seen in a direction indicated by an arrow P in FIG. 1. As shown, the toner drop section 13 for transferring the toner from the screw 6 to the screw 7 is positioned outside of the axial effective diameter portions of the rollers 3 and 4. The part of the toner conveyed by the screw 6, but not used for development or not deposited on the supply roller 4, is conveyed by the screw 6 to the end of the developing unit 1 opposite to the end where the hopper 11 is positioned. As a result, this part of the toner drops onto the bottom of the developing unit 1 at the drop section 13 due to its own weight. The screw 7, rotating in the direction E, receives the dropping toner and conveys it through the collection space 10 from the rear to the front as seen in FIG. 1 (from the right to the left in FIG. 2). Consequently, the toner is collected in the hopper 11 from the developing unit 1.

In the above developing procedure, by adequately selecting the amounts of toner to be conveyed by the screws 6 and 7, it is possible to feed the toner to the supply roller 4 without resorting to the detection of the amount of toner present in the developing unit 1 or complicated control over the amount of toner supply.

A reverse transfer portion 14 is formed at the end of the screw 7 disposed in the toner hopper 11. The reverse transfer portion 14 transfers the toner from the screw 7 to the screw 6. Assuming that the screw portion of the screw 7 is formed in the forward direction, the part of the screw portion lying in the reverse transfer portion 14 is formed in the reverse direction. Hence, in the hopper 11, the toner not used for development and conveyed from a developing section 16 in the forward direction and the toner returned from the end of the hopper 11 by the reverse transfer portion 14 in the reverse direction run against each other around a position where the forward and reverse portions of the screw 7 merge into each other. Because the bottom of the hopper 11 underlies the screw 7 and is contiguous with the casing 2, the two parts of the toner running against each other are forcibly raised away from the screw 7 into the operation range of the screw 6, as indicated by arrows in FIG. 3. Consequently, the toner is again conveyed to the developing section 16 by the screw 6 and joins in the development. This prevents the toner from cohering in the lower portion of the hopper 11. This, coupled with the fact that the collected toner is again used for development, reduces the amount of dead toner which does not contribute to development.

Figure 4:
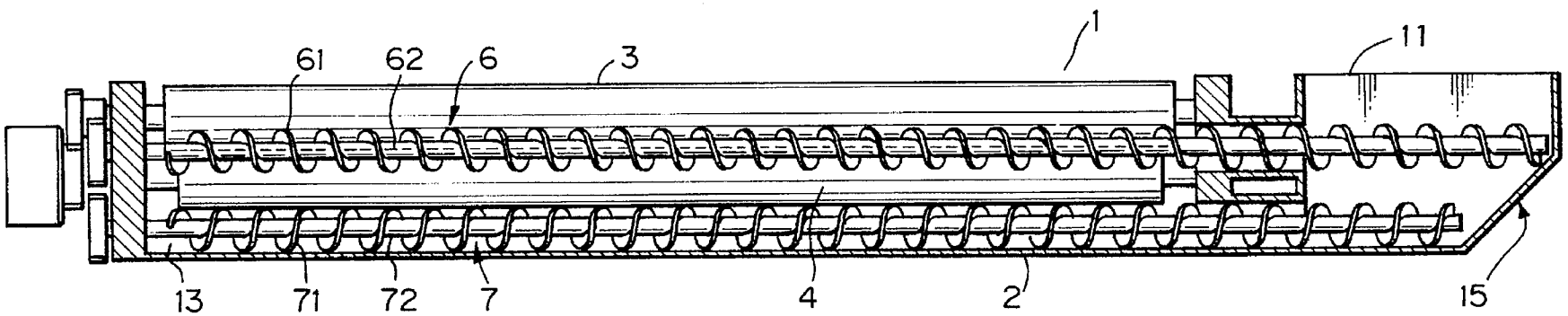
FIG. 4 is a sectional side elevation of an alternative embodiment of the present invention.

An alternative embodiment of the present invention will be described which also avoids the cohesion of toner and promotes the smooth conveyance of toner. FIG. 4 is a sectional side elevation of the alternative embodiment, as also seen in the direction P of FIG. 1. This embodiment is essentially similar to the previous embodiment except for that the bottom of the toner hopper 11 is inclined. In FIG. 4, the same constituent parts as the parts shown in FIG. 3 are designated by the same reference numerals, and a detailed description thereof will not be made in order to avoid redundancy.

As shown in FIG. 4, the bottom of the hopper 11 includes a slant 15 inclined from one end of the screw 7 to the corresponding end of the screw 6. For this reason, the screw 7 is formed shorter than the screw 6 at its end disposed in the hopper 11. In this configuration, the toner collected by the screw 7 is raised along the slant 15 into the operation range of the screw 6 and is again conveyed to the developing section 16 thereby. This prevents the toner from cohering at the bottom of the hopper 11 and ensures the smooth conveyance of the toner in the developing device.

If desired, the slant 15 may be replaced with a curved surface convex to the outside of the developing device and having a smooth inner surface. The curved surface will convey the toner more smoothly than the simple slant 15.

As stated above, the illustrative embodiment each consumes the toner without wasting it by smoothly conveying the collected toner and dead toner to the operation range of the screw 6 and reusing it. While the embodiments have been shown and described in relation to nonmagnetic toner, they are similarly practicable with magnetic toner or a two-ingredient type developer, i.e., a toner and carrier mixture.

In summary, it will be seen that the present invention provides a developing device having various unprecedented advantages, as enumerated below.

(1) A part of toner supplied from a developer storing section to a developing section by a first conveying member, but not used in a developing step, is collected in the storing section by a second conveying member. The collected toner is again fed to the developing section by the first conveying member and contributes to development. While the toner is so moved in the developing device, dead toner aggregating in the lower portion of the device and not contributing to development is forcibly moved. This, coupled with the collection of the toner, reduces the amount of dead toner not contributing to development and thereby prevents the toner from being wasted.

(2) A reverse transfer portion is formed at the end of the second conveying member adjoining the storing section. The toner conveyed by the reverse transfer portion runs against the toner conveyed from the developing section and is forcibly transferred to the first conveying member disposed above the second conveying member. The first conveying member again conveys this part of the toner to the developing section. This also achieves the above advantage (1).

(3) The toner conveyed by the second conveying member is forcibly raised along a slant into the operation range of the first conveying member. This part of the toner is again conveyed to the developing section by the first conveying member. This further reduces the amount of dead toner and obviates the waste of toner.

Various modifications will become possible for those skilled in the art after receiving the teachings of the present disclosure without departing from the scope thereof.

What is claimed is:

1. A developing device comprising:

a casing;

a developer carrier formed in the casing facing an image carrier on which a latent image is to be electrostatically formed;

a supply member formed in the casing to contact the casing and for supplying a developer to said developer carrier;

a first conveying member located above a position where said supply member supplies the developer to said developer carrier, and for conveying the developer from a storing section storing the developer to a developing section where said developer carrier and said supply member are positioned, the casing, developer carrier and supply member defining a toner supply space around the first conveying member;

a second conveying member located below said supply member and for conveying the developer not contributed to development in said developing section in a direction opposite to a direction of conveyance of said first conveying member;

a recirculation mechanism for forcibly recirculating the developer by transferring the developer from said second conveying member to said first conveying member; and a reverse transfer member provided on an end of said second conveying member disposed in said storing section, and for conveying, in said storing section, the developer in a direction from said storing section toward said developing section.

2. A developing device comprising:

a developer carrier facing an image carrier on which a latent image is to be electrostatically formed;

a supply member for supplying a developer to said developer carrier;

a first conveying member located above a position where said supply member supplies the developer to said developer carrier, and for conveying the developer from a storing section storing the developer to a developing section where said developer carrier and said supply member are positioned;

a second conveying member located below said supply member and for conveying the developer not contributed to development in said developing section in a direction opposite to a direction of conveyance of said first conveying member; and wherein said storing section has a bottom including a slant which is inclined from said end of said second conveying member to a corresponding end of said first conveying member.

3. The device as claimed in claim 2, wherein the first conveying member is a screw.

4. The device as claimed in claim 2, wherein the second conveying member is a screw.

5. The device as claimed in claim 2, wherein the first and second conveying members are screws.

6. The device as claimed in claim 2, wherein the first and second conveying members rotate in a same direction.

7. The device as claimed in claim 6, wherein the first and second conveying members are screws.

* * * * *